US009463469B2

(12) United States Patent
Morris et al.

(10) Patent No.: US 9,463,469 B2
(45) Date of Patent: Oct. 11, 2016

(54) SYSTEM AND METHOD OF RE-PROCESSING METAL PRODUCTION BY-PRODUCT

(71) Applicants: Richard Morris, Naperville, IL (US); Robert Stephen Watt, Chicago, IL (US)

(72) Inventors: Richard Morris, Naperville, IL (US); Robert Stephen Watt, Chicago, IL (US)

( * ) Notice: Subject to any disclaimer, the term of this patent is extended or adjusted under 35 U.S.C. 154(b) by 0 days.

(21) Appl. No.: 14/674,124

(22) Filed: Mar. 31, 2015

(65) Prior Publication Data

US 2015/0352562 A1 Dec. 10, 2015

Related U.S. Application Data

(60) Provisional application No. 62/007,540, filed on Jun. 4, 2014.

(51) Int. Cl.
*B03C 1/18* (2006.01)
*B03C 1/033* (2006.01)

(52) U.S. Cl.
CPC ..... *B03C 1/0332* (2013.01); *B03C 1/0335* (2013.01); *B03C 1/18* (2013.01); *B03C 2201/20* (2013.01)

(58) Field of Classification Search
CPC ..... B03C 1/16; B03C 1/18; B03C 1/22; B03C 1/247; B03C 1/30; B03C 2201/20
See application file for complete search history.

(56) References Cited

U.S. PATENT DOCUMENTS

| | | | | | |
|---|---|---|---|---|---|
| 1,453,699 | A * | 5/1923 | Brophy | B03C 1/01 | 209/214 |
| 2,291,042 | A * | 7/1942 | Kennedy | B03C 1/00 | 209/218 |
| 5,394,991 | A * | 3/1995 | Kumagai | B03C 1/247 | 209/212 |
| 5,823,354 | A * | 10/1998 | Elkind | B03C 1/23 | 209/212 |
| 7,367,457 | B2 * | 5/2008 | Warlitz | B03C 1/14 | 209/225 |
| 7,726,493 | B2 * | 6/2010 | Van Der Weijden | B03B 9/04 | 209/12.1 |
| 7,770,735 | B2 * | 8/2010 | Phillip | B03C 1/03 | 209/214 |
| 2015/0076037 | A1 * | 3/2015 | Yamamoto | B03B 9/00 | 209/11 |

* cited by examiner

*Primary Examiner* — Joseph C Rodriguez
(74) *Attorney, Agent, or Firm* — Dunlap Bennett & Ludwig PLLC

(57) ABSTRACT

A re-processing method for isolating a marketable free iron product and a non-metallic co-product from small-particulate metal production by-product is provided. The re-processing method may be adapted so that the resulting free iron product is marketable granules of various sizes and properties. The method may include refining the metal production by-product into a suitably sized and spaced feedstock. The feedstock may be fed into the system and, through exposure to a first magnetic field, isolated into a first free iron product and a first co-product. The first free iron product may continued through the system so as to further isolate into a second free iron product and a second co-product through exposure to a second magnetic field. The second free iron product may be the marketable granules of free iron product, while the first co-product and the second co-product may be combined and further isolated in the marketable non-metallic co-product. The re-processing method may be iterative in that the resulting second free iron product may be analyzed for determining beneficial modifications that can be made to the feedstock refinement and/or the first and/or second magnetic field isolation steps of the underlying method.

10 Claims, 2 Drawing Sheets

SYSTEM AND METHOD OF RE-PROCESSING METAL PRODUCTION BY-PRODUCT

CROSS-REFERENCE TO RELATED APPLICATION

This application claims the benefit of priority of U.S. provisional application No. 62/007,540, filed Jun. 4, 2014, the contents of which are herein incorporated by reference.

BACKGROUND OF THE INVENTION

The present invention relates to metal production and, more particularly, a process of producing marketable granulated free iron product and non-metallic products from iron, slag and other by-products of steelmaking. Steel producers and foundry operations generate millions of tons of iron and steel slag by-product when making steel and other desired metals from their raw ore. The problem is that small-particulate (less than ½") slag and other small-particulate steel-making by-product are generally considered unusable, and so are typically stockpiled or land-filled, thus creating environmental stress and increased cost for the steel company.

As can be seen, there is a need for a method for re-processing small particulates of steelmaking by-product into marketable metallic and non-metallic products.

SUMMARY OF THE INVENTION

In one aspect of the present invention, a method of re-processing particulate metal production by-product includes providing a feedstock having a first co-product; and a plurality of free iron particulates including a second co-product; and a plurality of high iron-content particulates; transporting the feedstock through a first magnetic separation stage configured to isolate the first co-product from the feedstock; and transporting the plurality of free particulates through a second magnetic separation stage configured to isolate the second co-product from the plurality of free particulates, wherein the plurality of free particulates was a product of the first magnetic separation stage.

In another aspect of the present invention, a system for re-processing a particulate metal production by-product includes a feeder/gate system configured to provide a predetermined spread of the particulate; a first two-prong router comprising a first magnetic component and a first non-magnetic substructure; a second two-prong router comprising a second magnetic component and a second non-magnetic substructure; a collection outlet; and at least one conveyor belt interconnecting the feeder, the first magnetic component, the second magnetic component and the collection outlet.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a re-processing method for isolating a marketable free iron product and a non-metallic co-product from small-particulate metal production by-product, such as oxidized iron, steel slag, fines, c-fines, slag and the like. The re-processing method may be adapted so that the resulting free iron product is marketable granules of various sizes and properties. The method may include refining the metal production by-product into a suitably sized and spaced feedstock. The feedstock may be fed into the system and, through exposure to a first magnetic field, isolated into a first free iron product and a first co-product. The first free iron product may continued through the system so as to further isolate into a second free iron product and a second co-product through exposure to a second magnetic field. The second free iron product may be the marketable granules of free iron product, while the first co-product and the second co-product may be combined and further isolated in the marketable non-metallic co-product. The re-processing method may be iterative in that the resulting second free iron product may be analyzed for determining beneficial modifications that can be made to the feedstock refinement and/or the first and/or second magnetic field isolation steps of the underlying method.

Figure 1:
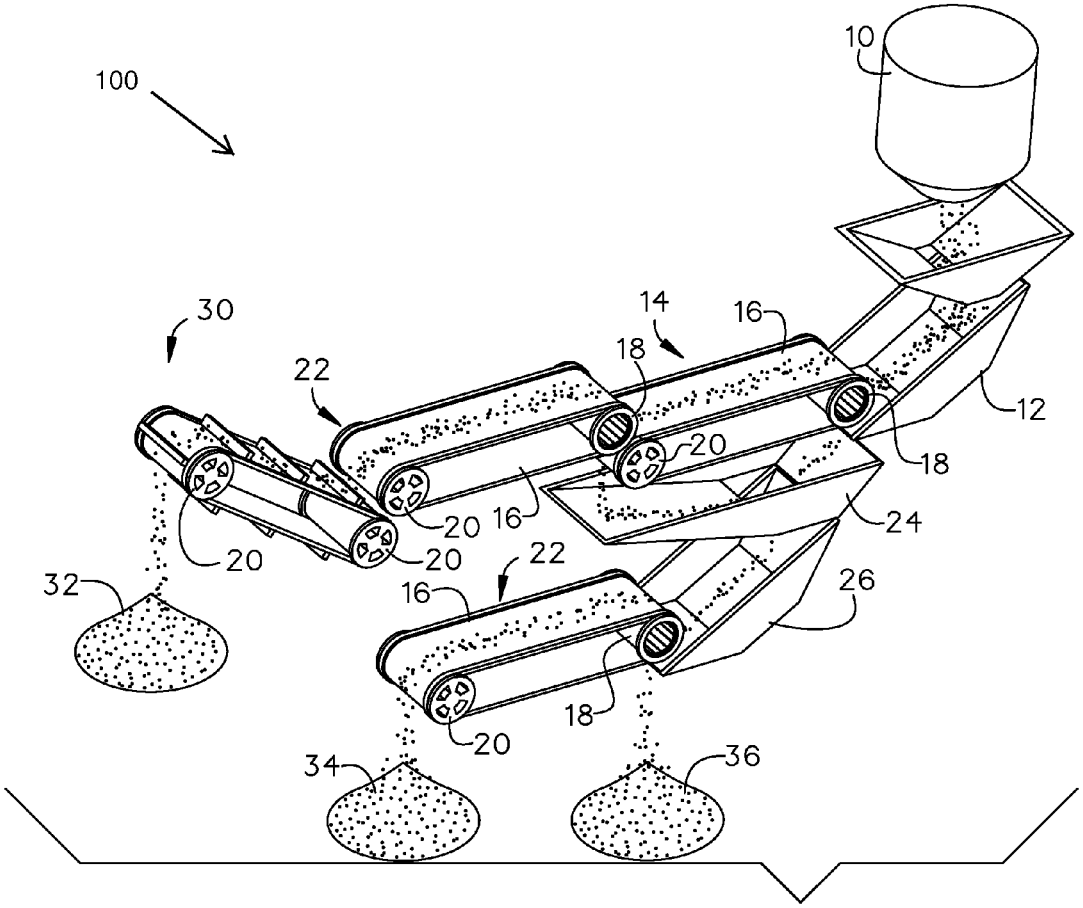
FIG. 1 is a perspective/schematic view of an exemplary embodiment of the present invention.

Referring now to FIG. 1, the present invention may include system embodying a re-processing method 100 for isolating a free iron product 32 and a non-metallic co-product 36 from a metal production by-product. The metal production by-product may include oxidized iron, steel slag, fines, c-fines, slag and the like. The re-processing method 100 may involve the reiteration of steps in order to make beneficial modifications from time to time. The metal production by-product may initially be refined into a particulate feedstock 50. The physical structure underlying the process may include, but not be limited to, a conveyor belt 16 interconnecting a series of collection bins, magnetic separation stages, and outlets. The conveyor belt 16 may be made of rubber or other non-magnetic material suitable for carrying the particulate feedstock 50 in an orderly, spaced manner.

Each magnetic separation stage may include a magnetic component 18 and a non-magnetic substructure 20 adapted to separate portions of the subject particulate, which may be feedstock 50, free iron, co-product or the like. Each magnetic separation stage may provide a two-pronged router, where portions of the subject particulate may be isolated by either flowing along a first prong/route or a second prong/route. The first prong/route may be defined by a suitable magnetic field so that components that are sufficiently magnetically attracted by the suitable magnetic field flow along the first prong; those components that are not sufficiently magnetically attracted by the suitable magnetic field take the second prong/route.

Figure 2:
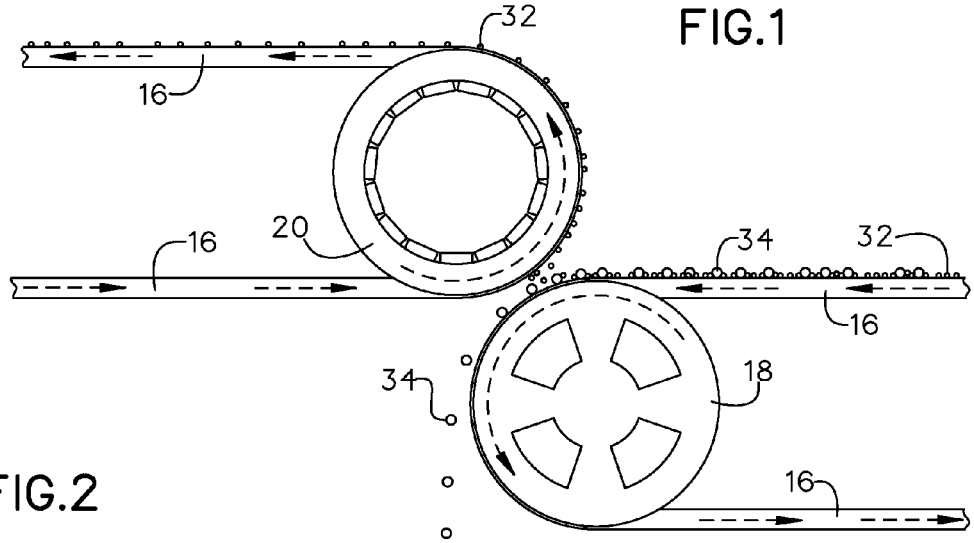
FIG. 2 is a detailed side/schematic view of an exemplary embodiment of the present invention.
Figure 3:
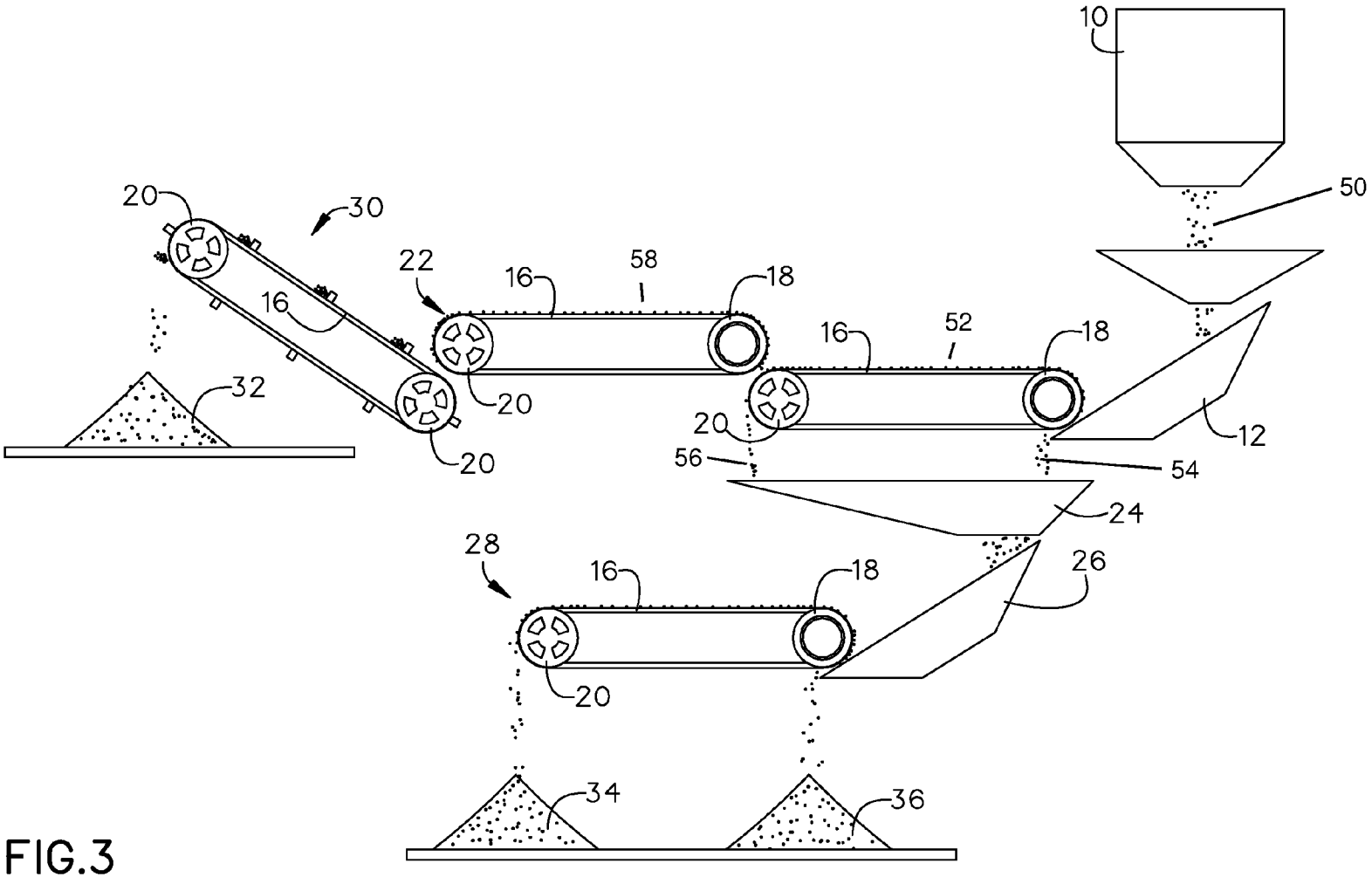
FIG. 3 is a side/schematic view of an exemplary embodiment of the present invention.

The suitable magnetic field may be a function of a magnetic gap, defined as the distance between the object magnetic component 18 and the subject particulate. The magnetic component 18 may include a permanent magnet or electromagnets formed into a electromagnetic drum, head pulley or over-band magnet adapted to be disposed within the conveyor belt 16 and/or the substructure components thereof without adversely affect the flow of the subject particulate, as illustrated in FIGS. 1 and 2. The substructure components may include the non-magnetic substructure 20 and collection bins. Each two-prong/router may be defined as the intersection of the magnetic component 18 and the substructure components.

The re-processing method 100 may include refining the metal production by-product so as to obtain a predetermined size and/or a granular profile. By way of example, the granular profile may be desired to be "very fine" and "course" cuts of particulate. The refinement may be initiated by mechanical abrasion of a raw product. The raw product may include the metal production by-product 40 among other things. A user may install an abrasion device 10 adapted to provide mechanical abrasion to the raw product so as to render the raw product to a predetermined particulate size. The abrasion device 10 may include tumbling to more aggressive grinding mills.

The method 100 may continue with the filtering of the abraded/crushed raw product so as isolate the feedstock 50 of the predetermined size and/or granular profile—"predetermined feedstock 50." The size depends on the incoming crushed raw product quality and can vary from, in certain embodiments, 200 mesh to ¾". The screening may be accomplished by, but not limited to, any type of double or triple deck screening plants.

In certain embodiments, the material quality of the raw product may be such that abrasion and/or screen may not be necessary; for example, when the original raw product is of the predetermined size and/or granular profile of the desired feedstock 50.

The method 100 may include further refinement by, in certain embodiments, a vibrating receiving hopper (or vibratory feeder) and gate system 12 that tumbles as well as spreads the resulting predetermined feedstock 50 on a conveyor belt 16 so as to facilitate a predetermined spread thereof. The predetermined spread may be defined as less than 2 inches of burden depth.

The method 100 may include passing the predetermined feedstock 50 through a first magnetic field found in a first magnetic separation stage 14. The first magnetic field may be adapted separate of free iron particulates 52 from a first co-product 54. The first co-product may be isolated into a co-product bin 24. The first co-product 54 may be transported to a co-product iron-oxide isolation process 28.

The co-product iron-oxide isolation process 28 may include an auxiliary magnetic separation stage field adapted to isolate iron oxide concentrate 34 from a non-metallic co-product 36. The non-metallic co-product 36 and the iron oxide concentrate 34 may emitted from the system through separate outlets to facilitate their respective collection. The non-metallic co-product 36 may be marketed for use in concrete, asphalt and other construction uses.

Separately, the free iron particulates 52 may be transported to a second magnetic separation stage 22 by way of the conveyor belt 16. The second magnetic separation stage 22 may provide a second magnetic field adapted isolate the free iron particulates 52 into a second co-product 56 and high iron-content particulate 32. The system may be adapted so that the second co-product 56 is isolated into the co-product bin 24, and from there routed through the same or similar co-product iron-oxide isolation process 28. The high iron-content particulate 32 may be emitted from the system by means of a stacking conveyor 30 to facilitate its collection, as illustrated in FIG. 1. The high iron-content particulate 32 may be marketable for having free iron and/or low melting point properties so as to be adapted for melting by, for example, primary metal producers, foundry operations and the like.

The re-processing method 100 may include further iron purification steps. In certain embodiments, field testing, chemical analysis, and lab melting of the high iron-content particulate 32 and co-products may be utilized to determine the optimum magnetic gap for all magnetic separation stages for subsequent uses for the predetermined size.

In certain embodiments, material grinding and drying steps could be added to further improve process yield and quality. Environmental controls for dust collection, water introduction for dust control and mechanical shielding of drop points may be considered, depending on the specific configuration of the equipment, climate, operation surroundings, and incoming material characteristics.

It should be understood, of course, that the components described above in the method 100 may be separated by distance and time. For example, the abrasion device 10 may be installed in a stationary and/or mobile configuration onsite or near site of the steel mill or foundry operations providing the raw product.

It should be understood, of course, that the foregoing relates to exemplary embodiments of the invention and that modifications may be made without departing from the spirit and scope of the present invention.

What is claimed is:

1. A method of re-processing particulate metal production by-product, comprising:

providing a feedstock comprising:

a first co-product; and a plurality of free iron particulates comprising:

a second co-product; and a plurality of high iron-content particulates;

providing a first magnetic separation stage and a second magnetic separation stage so that the second magnetic separation stage is at a higher elevation than the first magnetic separation stage;

transporting the feedstock through the first magnetic separation stage configured to isolate the first co-product from the feedstock; and transporting the plurality of free iron particulates through the second magnetic separation stage configured to isolate the second co-product from the plurality of free particulates, wherein the plurality of free iron particulates was a product of the first magnetic separation stage.

2. The method of claim 1, further including collecting the plurality of high iron-content particulates, wherein the plurality of free iron particulates was a product of the second magnetic separation stage.

3. The method of claim 1, further providing a feeder/gate system configured to provide a predetermined spread of the feedstock.

4. The method of claim 1, wherein the first and second co-product comprises an iron oxide concentrate and a non-metallic co-product.

5. The method of claim 4, further including transporting the first co-product and the second co-product through an auxiliary magnetic separation stage configured to isolate the non-metallic co-product from the first and second co-product.

6. A system for re-processing a particulate metal production by-product, comprising:

a feeder/gate system configured to provide a predetermined spread of the particulate;

a first two-prong router comprising a first magnetic component and a first non-magnetic substructure;

a second two-prong router comprising a second magnetic component and a second non-magnetic substructure, wherein the second two-prong router is disposed at a higher elevation than the first two-prong router;

a collection outlet; and at least one conveyor belt interconnecting the feeder, the first magnetic component, the second magnetic component and the collection outlet.

7. The system of claim 6, further comprising an abrasion device in communication with the feeder/gate system.

8. The system of claim 6, wherein the collection outlet provides a stacking conveyor.

9. The system of claim 6, further comprising an auxiliary two-prong router in communication with the first non-magnetic substructure and the second non-magnetic substructure, wherein the auxiliary two-prong router comprising an auxiliary magnetic component and an auxiliary non-magnetic substructure.

10. The system of claim 9, further providing at least one collection bin interconnecting the auxiliary two-prong router and the first non-magnetic substructure and the second non-magnetic substructure.

* * * * *